United States Patent [19]

Marcum, Jr.

[11] 4,186,538

[45] Feb. 5, 1980

[54] PANEL OF SIDING

[75] Inventor: Maxie G. Marcum, Jr., Ballwin, Mo.

[73] Assignee: Aluminum Industries, Inc., Manchester, Mo.

[21] Appl. No.: 904,555

[22] Filed: May 10, 1978

[51] Int. Cl.[2] ..... E04D 1/34; E04D 3/361

[52] U.S. Cl. ..... 52/521; 52/530; 52/573

[58] Field of Search ..... 52/521, 530, 522, 573, 52/478, 241, 543

[56] References Cited

U.S. PATENT DOCUMENTS

| | | | |
|---|---|---|---|
| 705,207 | 7/1902 | Charlebois | 52/530 |
| 3,177,620 | 4/1965 | Brown et al. | 52/573 X |
| 3,229,436 | 1/1966 | Gerhart et al. | 52/521 |
| 3,325,952 | 6/1967 | Trachtenberg | 52/530 X |

FOREIGN PATENT DOCUMENTS

| | | | |
|---|---|---|---|
| 251844 | 1/1967 | Austria | 52/530 |

*Primary Examiner*—Alfred C. Perham

*Attorney, Agent, or Firm*—Senniger, Powers, Leavitt and Roedel

[57] ABSTRACT

An elongate panel of siding to be mounted generally horizontally on the wall of a building. This panel, which may be of thin sheet metal, has two opposing faces, constituting inside and outside faces, and upper and lower longitudinal edges. Hooks are bent down from the upper edge on the outside face of the panel and a plurality of holes are spaced below but relatively close to the upper edge of the panel for receiving fasteners to secure the panel to the wall. At the lower edge of the panel is a continuous flange bent to extend inwardly from the lower edge of the panel and having a lip bent up at its inner edge for engaging the hooks of the panel therebelow on the wall.

4 Claims, 5 Drawing Figures

PANEL OF SIDING

BACKGROUND OF THE INVENTION

This invention relates to panels of siding, and more particularly to such a panel adapted for application to a wall of a building with upper and lower edges of the panels hooked together.

The invention involves an improvement over a prior siding panel of this general class having hook means at the upper edge of the panel constituted by a marginal portion of the panel bent down on the outside face of the panel on a first line to form a hook and bent back up upon itself on a second line below the first line to form a fastening flap extending up above the first line, this flap having holes above the first line for receiving fasteners (nails) for fastening the panel to the wall. This flap involves a considerable width of material (e.g., sheet aluminum) of which the panel is formed.

SUMMARY OF THE INVENTION

Among the several objects of the invention may be noted the provision of an improved siding panel of the class described which, while having hook means at its upper and lower edges for hooking together the panels at these edges, involves less material (e.g., sheet aluminum) than the stated prior panel; and the provision of such a panel which may be readily mounted on the wall of a building and which is pleasing in appearance for enhancing the attractiveness of the building.

Generally, an improved panel of siding of this invention is adapted to be mounted generally horizontally on the wall of a building. The panel may be of thin sheet metal or the like and has two opposing faces, one constituting an inside face which faces the wall and the other constituting an outside face which faces away from the wall, the panel further having upper and lower longitudinal edges. Upper hook means is bent down from the upper edge of the panel on the outside face thereof, terminating at an edge below the upper edge of the panel. Spaced below but relatively close to the upper edge of the panel are holes for receiving fasteners to secure the panel to the wall. Lower hook means along the lower edge of the panel on the inside face thereof is adapted to engage the upper hook means of a panel therebelow on the wall thereby to mount the panels on the wall with the panels secured thereto by fasteners extending through the aforesaid holes and with the lower hook means of the upper one of the panels interengaged with the upper hook means of the lower one of the panels.

Other objects and features will be in part apparent and in part pointed out hereinafter.

BRIEF DESCRIPTION OF THE DRAWINGS

Corresponding reference characters indicate corresponding parts throughout several views of the drawings.

DESCRIPTION OF THE PREFERRED EMBODIMENT

Figure 1:
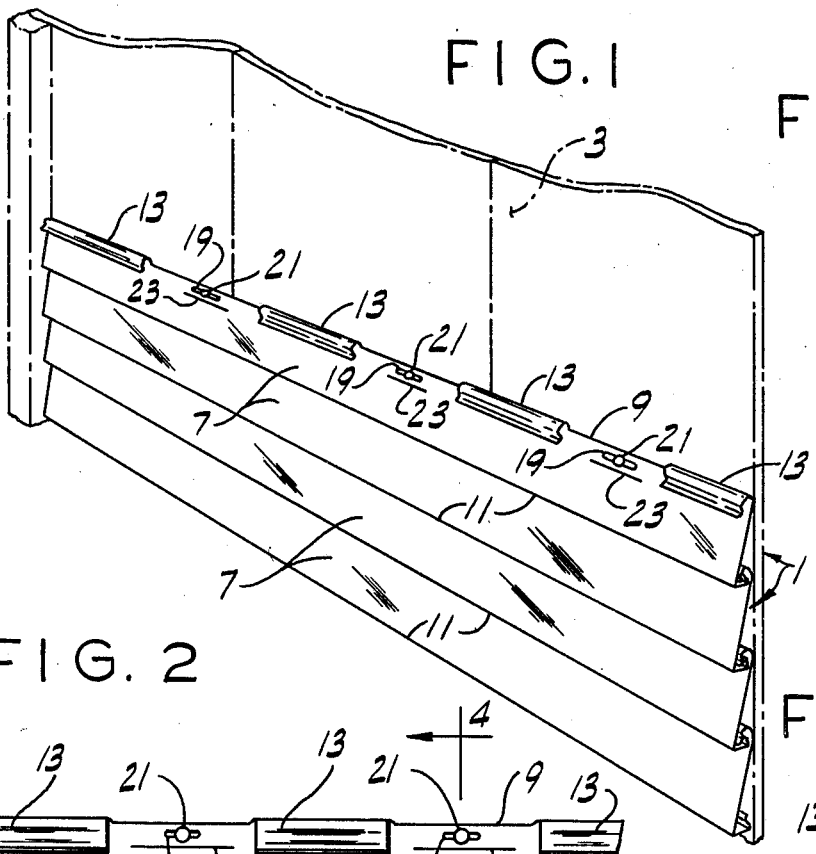
FIG. 1 is a perspective of a plurality of interconnected elongate panels of this invention mounted on the wall of a building, certain features of these panels being enlarged for purposes of illustration.
Figure 3:
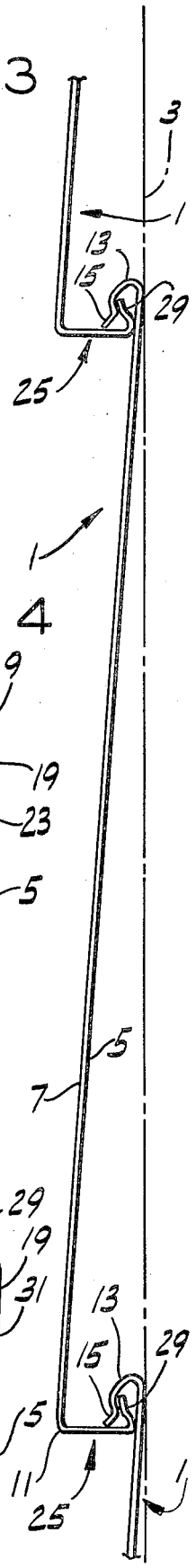
FIG. 3 is an enlarged fragmentary right end elevation of FIG. 1.
Figure 2:
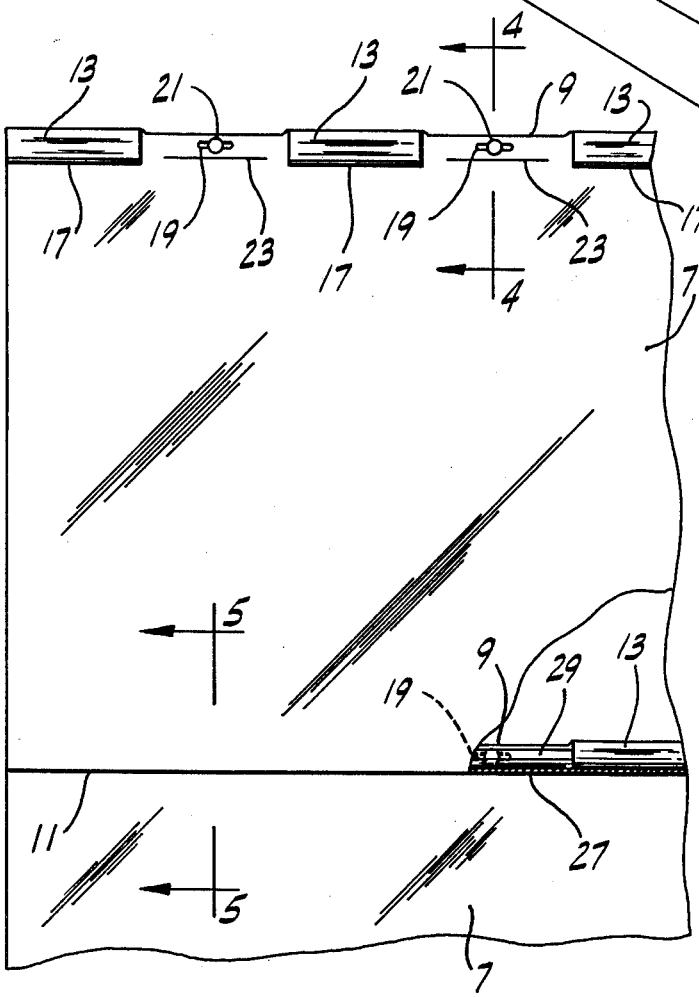
FIG. 2 is an enlarged front elevational view of a portion of FIG. 1 with parts broken away to illustrate details.
Figure 4:
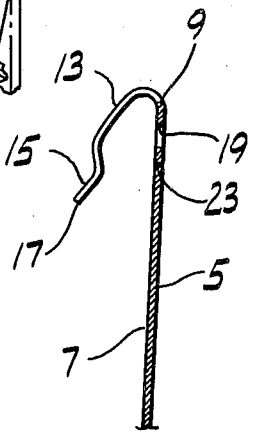
FIG. 4 is an enlarged section on line 4—4 of FIG. 2.

Referring to the drawings, first more particularly to FIGS. 1 and 3, elongate panels of siding of this invention, each designated by the reference numeral 1, are shown mounted generally horizontally on the wall 3 of a building. Each of these panels 1, which may be of thin (e.g., 0.024 in. (0.61 mm.) or 0.019 in. (0.48 mm.)) sheet metal such as aluminum, has two opposing faces, the one shown facing the wall in the drawings being denominated the inside face 5 and the one facing away from the wall being denominated the outside or exposed face 7. This latter face generally has a vinyl, acrylic or other suitable weather-resistant coating thereon. The siding panels 1 each have upper and lower longitudinal edges as indicated at 9 and 11, respectively.

In accordance with this invention, a plurality of hooks, each designated 13 and together constituting upper hook means, are spaced at equal intervals (e.g., every 4 in. for 2 in. long hooks) along the upper edge of each panel and are bent down from that edge on the outside face 7 of the panel. These hooks, the lower margins 15 of which are flared outwardly, each terminate at an edge 17 below the upper longitudinal edge 9 of the panel. Indicated at 19 between the hooks 13 and spaced below but relatively close to the upper edge 9 of each panel 1 are holes in the form of elongate horizontal slots in the panel for receiving fasteners 21 (e.g., nails) to secure the panel to the wall 3. These holes or slots 19 are preferably at a level generally above that of the terminal edges 17 of the hooks. A slit 23 is provided below each slot at a level generally above that of the terminal edges 17 of the hooks for preventing deformation (cambering, for example) of the panel below the slits when fasteners 21 are driven tightly into place through the slots 19. As shown, the length of each of the slits 23 is greater than that of a respective slot.

Figure 5:
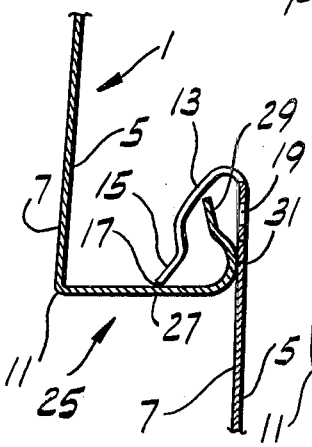
FIG. 5 is an enlarged section on line 5—5 of FIG. 2.

At 25 is generally indicated lower hook means comprising a continuous flange along the lower longitudinal edge 11 of the panel 1, this flange being bent to extend inwardly from edge 11. The flange has an inner web portion 27 extending generally perpendicularly from the panel and an outer marginal portion bent upwardly from the inner web portion and thence slightly back toward the inside face 5 of the panel and forming an upwardly extending lip 29. As best illustrated in FIG. 5, this lower hook means 25 of a panel engages the hooks 13 of the next panel below to interconnect the two panels in the manner shown. Thus, with the lower margin of the upper panel overlapping the upper margin of the lower panel on the outside face 7 of the latter, the outer lip portion 29 of the flange of the upper panel engages the outside face 7 of the lower panel at 31 and extends up into the space between the outside face and upper hooks 13 of the lower panel. The terminal edges 17 of the hooks (the lower edges of the hooks) are in contact with the inner web portion 27 of flange 25 of the upper panel. As shown, the point 31 at which the outer lip portion 29 of the flange of the upper panel contacts the outside face 7 of the lower panel is at a level below that of the holes 19 in that panel, thus sealing the holes from the weather and tending to prevent moisture from seeping through the holes and into the area behind the lower panel. The fasteners 21 are also protected from the elements. The holes and fasteners are also hidden from view.

Panels 1 of siding of this invention are readily mounted on a wall, such as wall 3, of a building by first securing the lowermost panel to the wall in the appropriate position by means of fasteners 21 (e.g., nails) driven through the holes or slots 19. The flange 25 of the next panel is then brought into interengagement with the hooks 13 of the lowermost panel in the manner described above. The next panel is then nailed (or otherwise secured) in position to the wall. This process is repeated with additional panels being successively mounted one above the other until the job is completed.

In view of the foregoing, it will be apparent that panels 1 are designed for minimizing the amount of sheet material, such as aluminum, required to produce the panel. Thus, in sharp contrast to the stated type of prior art siding panel in which the upper margin of the panel is bent down to form a hook and then bent back up on itself to form the fastening flap with the flap having holes therein toward the upper edge of the panel above the hook, the hooks 13 bent down from the upper edge of the panel of this invention terminate at edges 17 which, along with the nail holes 19 in the panel, are below the upper edge of the panel, thus avoiding use of the flap of sheet material bent up from the hook in the prior art panels, and saving a considerable amount of material.

The panels are also pleasing in appearance for enhancing the attractiveness of a building.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. An elongate panel of siding adapted to be mounted generally horizontally on the wall of a building, said panel being of thin sheet metal or the like and having two opposing faces, one constituting an inside face which faces said wall and the other constituting an outside face which faces away from the wall, said panel further having upper and lower longitudinal edges, upper hook means comprising a plurality of separate hooks spaced at intervals along the upper edge of the panel and bent down from the upper edge on the outside face of the panel, each of the hooks terminating at an edge below the upper edge of the panel, a plurality of elongate horizontal slots spaced below the upper edge of the panel between the hooks at a level generally above that of the terminal edges of the hooks for receiving fasteners to secure the panel to the wall, slits below the slots for preventing deformation of the panel below the slit when the panel is secured to the wall via the fasteners, and lower hook means along the lower edge of the panel on the inside face thereof for engaging the upper hooks of a panel therebelow on the wall thereby to mount the panels on the wall with the panels secured thereto by fasteners extending through said slots and with the lower hook means of the upper one of the panels interengaged with the upper hooks of the lower one of the panels.

2. A panel of siding as set forth in claim 1 wherein said slits are at a level generally above that of the terminal edges of the hooks.

3. A panel of siding as set forth in claim 1 wherein the length of each of said slits is greater than that of a respective slot.

4. A panel of siding as set forth in claim 1 wherein the lower hook means comprises a flange extending continuously along the lower edge of the panel, said flange being bent to extend inwardly from the lower edge of the panel and having a marginal portion bent up to form an upwardly extending lip spaced inwardly from the inside face of the panel, said lip of the flange on a panel being engageable with the outside face of the next panel below at a level below that of the slots in said next panel below and adapted to extend up into the space between the upper hooks and the outside face of the next panel below.

* * * * *